US009124014B2

(12) United States Patent
Zhang

(10) Patent No.: US 9,124,014 B2
(45) Date of Patent: Sep. 1, 2015

(54) AUDIO JACK CONNECTOR WITH SMALL SIZE FOR SPACE SAVING

(71) Applicant: HON HAI PRECISION INDUSTRY CO., LTD., New Taipei (TW)

(72) Inventor: Wei-De Zhang, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 96 days.

(21) Appl. No.: 13/834,545

(22) Filed: Mar. 15, 2013

(65) Prior Publication Data

US 2013/0244498 A1 Sep. 19, 2013

(30) Foreign Application Priority Data

Mar. 16, 2012 (CN) ..... 201210070025

(51) Int. Cl.

| | |
|---|---|
| ***H01R 13/648*** | (2006.01) |
| ***H01R 13/40*** | (2006.01) |
| ***H01R 13/41*** | (2006.01) |
| ***H01R 24/58*** | (2011.01) |
| *H01R 24/50* | (2011.01) |
| *H01R 12/71* | (2011.01) |

(52) U.S. Cl.
CPC ..... *H01R 13/40* (2013.01); *H01R 13/41* (2013.01); *H01R 24/58* (2013.01); *H01R 12/716* (2013.01); *H01R 24/50* (2013.01)

(58) Field of Classification Search
CPC ..... H01R 24/50; H01R 24/58
USPC ..... 438/668, 658
See application file for complete search history.

(56) References Cited

U.S. PATENT DOCUMENTS

| | | | | |
|---|---|---|---|---|
| 6,575,793 | B1 * | 6/2003 | Li et al. | 439/668 |
| 6,595,804 | B2 * | 7/2003 | Nagata | 439/668 |
| 6,676,451 | B2 * | 1/2004 | Suzuki et al. | 439/668 |
| 6,790,095 | B2 * | 9/2004 | Liu | 439/668 |
| 7,033,226 | B1 * | 4/2006 | Chien et al. | 439/668 |
| 7,094,088 | B2 * | 8/2006 | Wang et al. | 439/188 |
| 7,361,062 | B2 * | 4/2008 | Long et al. | 439/668 |
| 7,553,194 | B2 * | 6/2009 | Wang et al. | 439/668 |
| 7,566,242 | B2 * | 7/2009 | Zhu et al. | 439/567 |

(Continued)

FOREIGN PATENT DOCUMENTS

| | | |
|---|---|---|
| CN | 2428878 | 5/2001 |
| CN | 2916982 | 6/2007 |

(Continued)

*Primary Examiner* — Felix O Figueroa
(74) *Attorney, Agent, or Firm* — Ming Chieh Chang; Wei Te Chung

(57) ABSTRACT

An audio jack connector (100) includes an insulative housing (1), a first contact (21) and a second contact (22) retained in the insulative housing. The insulative housing defines a receiving channel (14). The first contact includes a first retaining portion (211), a first soldering portion (212) bent from the first retaining portion, and a first contacting portion (213) extending from the first retaining portion. The second contact includes a second contacting portion (221) extending into the receiving channel, an upper beam (222) and a lower beam (223) forkedly extending from the contacting portion, a hook portion (224) formed at the distal end of the upper beam and secured with the insulative housing, and a second soldering portion (225) bent from the lower beam. An interspace (226) is defined between the upper beam and the lower beam. The first contacting portion protrudes into the receiving channel via the interspace.

20 Claims, 6 Drawing Sheets

(56) References Cited

U.S. PATENT DOCUMENTS

| | | | | |
|---|---|---|---|---|
| 7,726,990 | B2 * | 6/2010 | Wang et al. | 439/188 |
| 7,753,738 | B2 * | 7/2010 | Zhang | 439/668 |
| 2010/0279553 | A1 | 11/2010 | Izumi | |

FOREIGN PATENT DOCUMENTS

| | | |
|---|---|---|
| CN | 201113048 | 9/2008 |
| CN | 201303089 | 9/2009 |

* cited by examiner

AUDIO JACK CONNECTOR WITH SMALL SIZE FOR SPACE SAVING

CROSS-REFERENCE TO RELATED APPLICATIONS

This patent application relates to a U.S. patent application filed on Mar. 15, 2013, having an unknown Ser. No. and entitled "AUDIO JACK CONNECTOR PREVENTING GROUNDING CONTACT FROM DEFLECTION", which is assigned to the same assignee as this application.

BACKGROUND OF THE INVENTION

1. Field of the Invention

The present invention relates generally to an audio jack connector, and more particularly to an audio jack connector with small size for space saving purpose.

2. Description of Related Arts

A multipolar plug is used to receive audio signals from a plurality of electrical devices such as mobile phones, MP3s, and so on. The electrical device usually has an audio jack connector receiving the audio plug. The audio jack connector comprises an insulative housing and a plurality of contacts retained in the insulative housing. The insulative housing defines a receiving channel for the audio plug. The contacts are arranged at two sides of the receiving channel. Each contact has a contacting portion engaging with the audio plug. The contacts at the same side are not so configured as to intersect with each other for the purpose of saving space. Either U.S. Patent Application Publication No. 2010/0279553 or China Patent No. 201303089 discloses an audio jack connector comprising a pair of switch terminals that intersect with each other along a transverse direction perpendicular to a mating direction along which an audio plug is inserted. The switch terminals comprise an immovable contact and a movable contact. The immovable contact is retained in the insulative housing. The immovable contact has a first contacting portion detachably engaged with a second contacting portion of the movable contact for detecting purpose. The first contacting portion of the immovable contact does not extend into a receiving channel of the insulative housing for contacting with the audio plug.

Hence, an audio jack connector for space saving purpose is desired.

SUMMARY OF THE INVENTION

Accordingly, an object of the present invention is to provide an audio jack connector for space saving purpose.

To achieve the above object, an audio jack connector includes an insulative housing, a first contact and a second contact retained in the insulative housing. The insulative housing defines a receiving channel. The first contact includes a first retaining portion, a first soldering portion bent laterally from the first retaining portion, and a first contacting portion extending from the first retaining portion. The second contact includes a second contacting portion extending into the receiving channel, an upper beam and a lower beam forkedly, backwardly extending from the contacting portion, a hook portion formed at the distal end of the upper beam and secured with the insulative housing, and a second soldering portion bent laterally from the lower beam. An interspace is defined between the upper beam and the lower beam and the first contacting portion protrudes into the receiving channel via the interspace.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1 to 6, an audio jack connector 100 of the present invention comprises an insulative housing 1, a plurality of contacts 2 retained in the insulative housing 1, and a securing board 3 assembled to the insulative housing 1 for assembling the insulative housing 1 on a printed circuit board (not shown).

Figure 1:
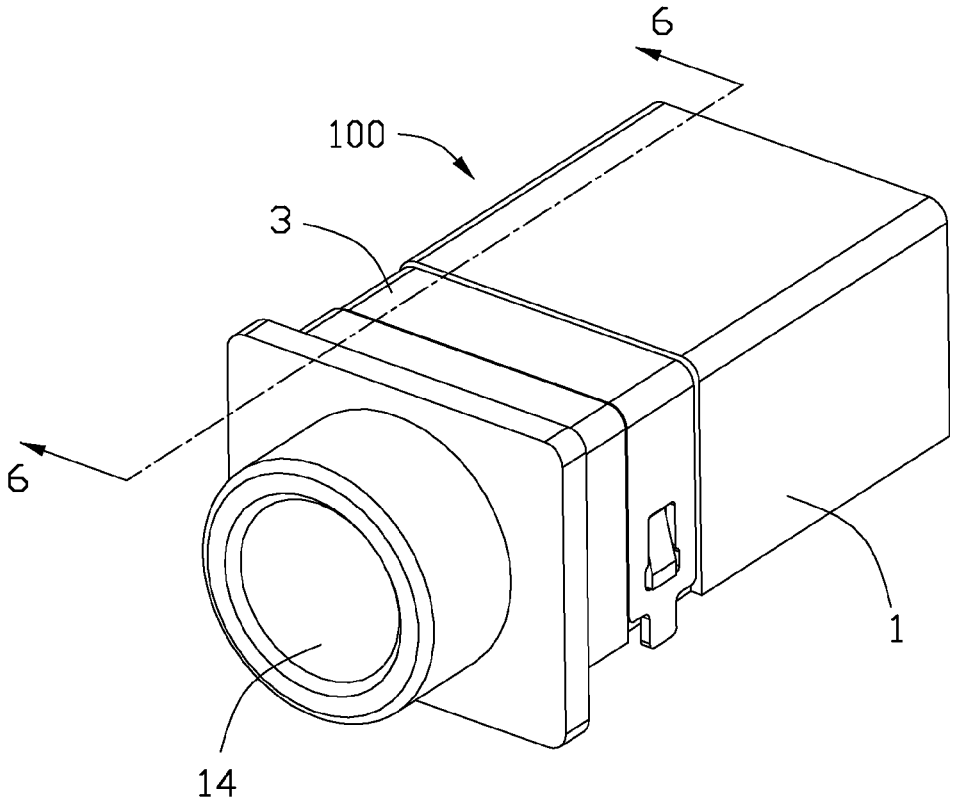
FIG. 1 is a perspective, assembled view of an audio jack connector according to the present invention.
Figure 2:
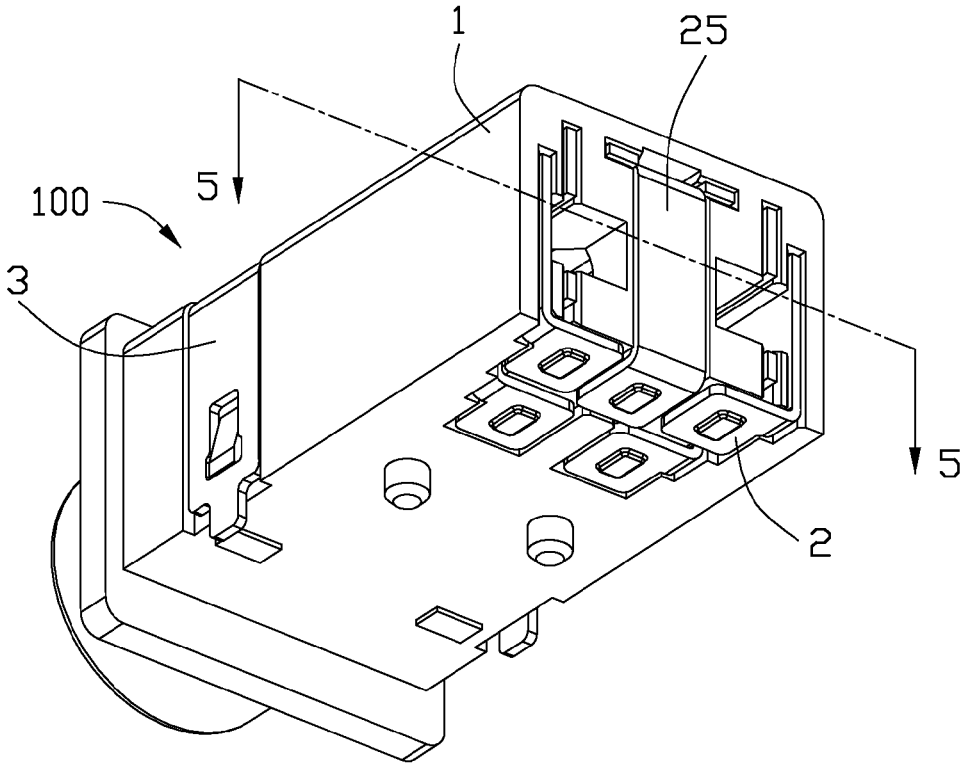
FIG. 2 is another perspective, assembled view of the audio jack connector.
Figure 3:
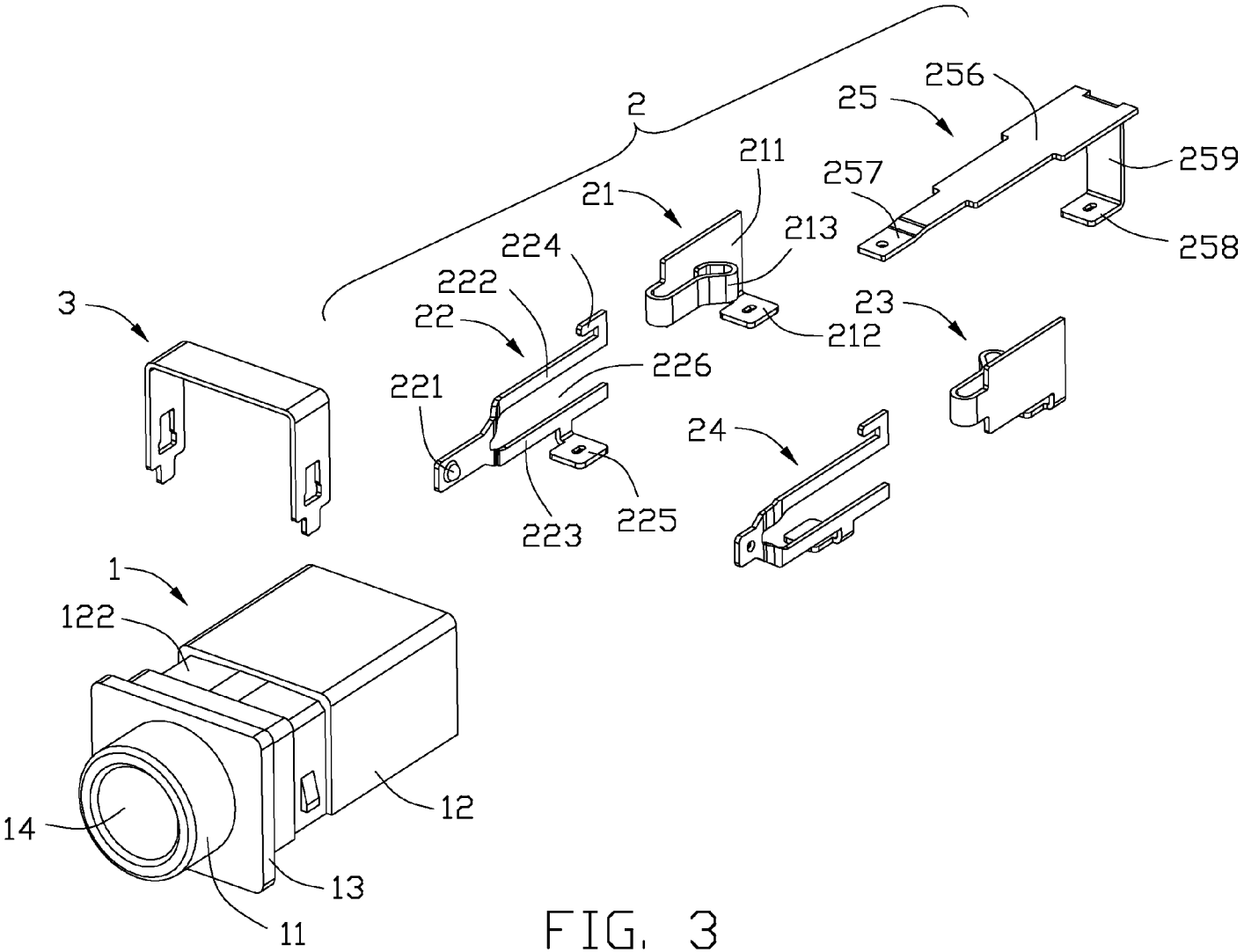
FIG. 3 is a perspective, exploded view of the audio jack connector.
Figure 4:
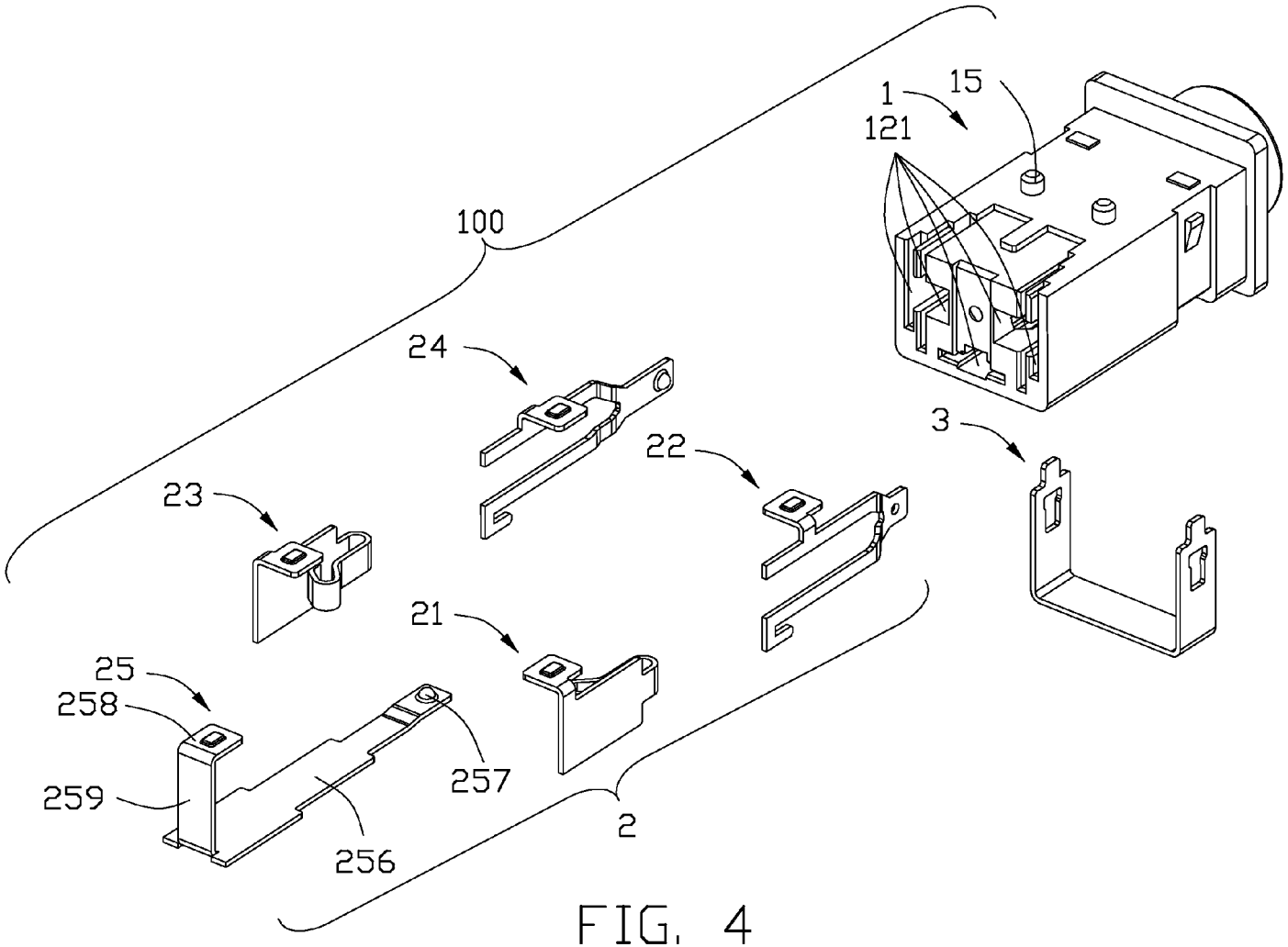
FIG. 4 is another perspective, exploded view of the audio jack connector.
Figure 5:
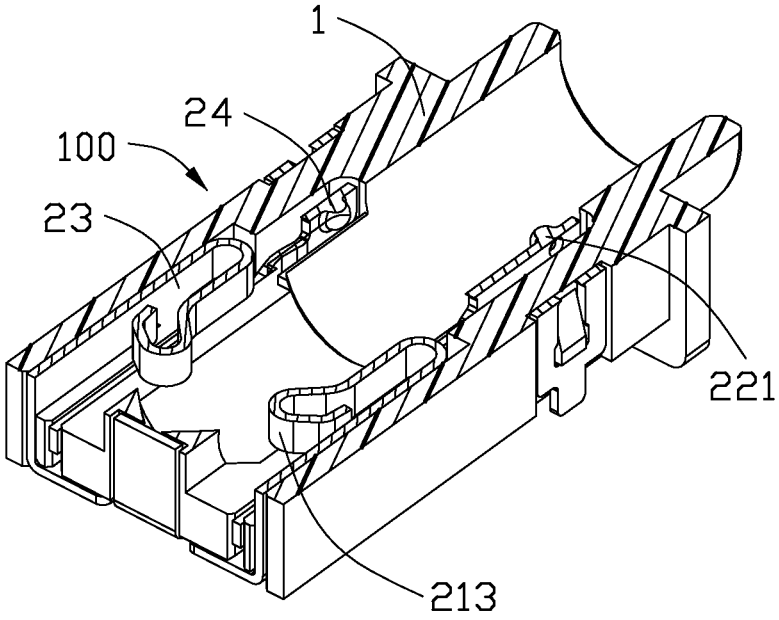
FIG. 5 is a cross-sectional view of FIG. 2 when taken along line 5-5.
Figure 6:
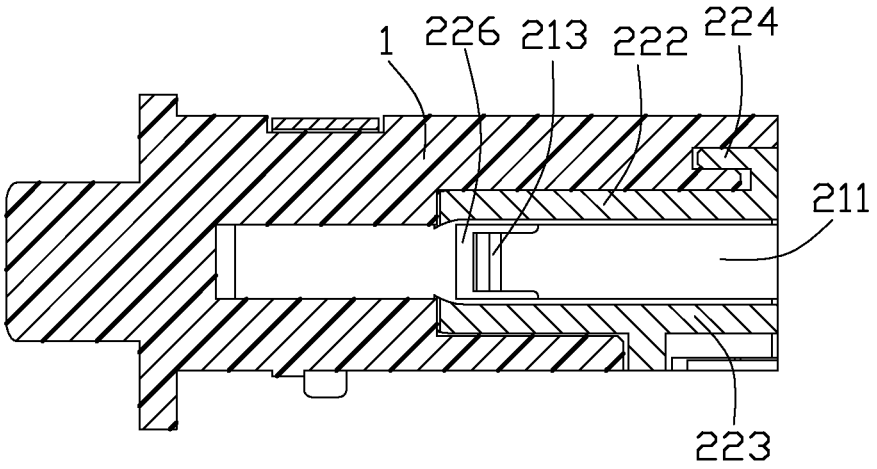
FIG. 6 is a cross-sectional view of FIG. 1 when taken along line 6-6.

Referring to FIGS. 3 and 4, the insulative housing 1 comprises a circular head portion 11, a rectangular base portion 12, and a neck portion 13 connected between the head portion 11 and the base portion 12. The insulative housing 1 defines a receiving channel 14 extending through the head portion 11, the neck portion 13, and the base portion 12. The base portion 12 defines a plurality of terminal passageways 121 communicating with the receiving channel 14. The base portion 12 defines a recess portion 122 adjacent to the neck portion 13. The securing board 3 is secured in the recess portion 122. The neck portion 13 protrudes out of the head portion 11 and the base portion 12. The insulative housing 1 defines an insertion opening (not labeled) on the head portion 11 which communicates with the receiving channel 14, a rear face opposite to the insertion opening and a mounting face abutting the printed circuit board. Therefore, a mating direction is defined by the insertion opening. The mounting face forms a pair of protrusions 15. The protrusions 15 and the securing board 3 are both fixed to the printed circuit board.

Referring to FIGS. 3 to 6, the contacts 2 comprises a first contact 21 and a second contact 22 both at a left side of the receiving channel 14, a third contact 23 and a fourth contact 24 both at a right side of the receiving channel 14, and a fifth contact 25 at an upper side of the receiving channel 14. The first contact 21 comprises a first retaining portion 211, a first soldering portion 212 bent laterally from a lower edge of the first retaining portion 211, and a first contacting portion 213 extending reversely from a front edge of the first retaining portion 211 into the receiving channel 14. The second contact 22 comprises a second contacting portion 221 extending into the receiving channel 14, an upper beam 222 and a lower beam 223 forkedly, backwardly extending from the contacting portion 221, a hook portion 224 formed at the distal end of the upper beam 222, and a second soldering portion 225 bent laterally from the lower beam 223. The upper beam 222 and the lower beam 223 are flexible. The hook portion 224 is used for securing with the insulative housing 1 and therefore, the upper beam 222 is prevented from dropping down due to its own weight. An interspace 226 is defined between the upper beam 222 and the lower beam 223. The first contacting portion 213 protrudes into the receiving channel 14 via the interspace 226. Therefore, the second contact 22 and the first contact 21 intersect with each other along a transverse direction perpendicular to the mating direction.

Referring to FIGS. 3 and 4, the fifth contact 25 comprises a flatly and forwardly extending fifth retaining portion 256, a fifth contacting portion 257 extending forwardly from the fifth retaining portion 256 into the receiving channel 14, a fifth soldering portion 257 extending forwardly as the fifth retaining portion 256 but be arranged at a level lower than the fifth retaining portion 256, and a vertically extending connecting portion 259 connected between the fifth retaining portion 256 and the fifth soldering portion 257. The fifth contact 25 is a grounding contact. Take a view along the mating direction, the fifth contacting portion 257 is the nearest to the insertion hole for timely releasing electrostatic charge.

Each contact 2 has a soldering portion (such as the first soldering portion 212 of the first contact 21, the second soldering portion 225 of the second contact portion 22, and the fifth soldering portion 257 of the fifth contact 25, while a third soldering portion of the third contact 23 and a fourth soldering portion of the fourth contact 24 are both not labeled), and all of the soldering portions are exposed on the mounting face of the insulative housing 1 in two lines, which facilitates soldering the soldering portions on the printed circuit board.

Because the interface 226 is defined between the upper beam 222 and the lower beam 223, the upper beam 222 has a small width which induces that the upper beam 222 is flexible and prone to deflect towards the lower beam 223. The first contact 21 and the second contact 22 intersect with each other for space saving purpose and the first contacting portion 213 extends into the receiving channel 14 via the interface 226, the hook portion 224 of the second contact 22 which connects with the upper beam 223 and engages with the insulative housing 1 prevents the upper beam 223 from deflecting towards the lower beam 223, and therefore, prevents the first contact 21 and the second contact 22 from interfering with each other.

The third contact 23 has a same structure with respect to the first contact 21 and the fourth contact 24 has a same structure with respect to the second contact 22, except the size. Therefore, the fourth contact 24 and the third contact 23 intersect with each other along a transverse direction perpendicular to the mating direction, too. Therefore, a transverse size of the audio jack connector 100 is reduced.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector for use with a plug, comprising:

an insulative housing defining a central receiving channel extending along a front-to-back direction with an insertion opening in a front side of the housing;

two pairs of terminal passageways formed in the housing, each of said terminal passageways communicating transversely with the receiving channel and rearwardly with an exterior, each pair of terminal passageways including an outer terminal passageway and an inner terminal passageway;

two pairs of contacts disposed in the two pairs of terminal passageways, respectively, and categorized with outer and inner contacts corresponding to the outer and inner terminal passageways, each of said outer and inner contacts assembled into a corresponding terminal passageway forwardly from a rear side of the housing, each of said outer and inner contacts defining a contacting section extending into the receiving channel for engagement with a plug and a mounting section exposed outside of the housing for mounting to a printed circuit board; wherein the contacting section of the inner contact and the contacting section of the corresponding outer contact are located at the same level while the contacting section of the inner contact is located in front of that of the corresponding outer contact, and a rear portion of the inner contact defines a space through which the contacting section of the corresponding outer contact extends for entering the receiving channel transversely; and wherein the inner contact defines an upper beam and a lower beam between which said space is formed, and the contacting section of the inner contact is inwardly offset from the upper beam and the lower beam along a transverse direction perpendicular to the front-to-back direction to enter into the receiving channel.

2. The electrical connector as claimed in claim 1, wherein the contacting section of the outer contact extend backward in a folded manner.

3. The electrical connector as claimed in claim 1, wherein the mounting sections of the contacts extend horizontally on an underside of the housing, and that of the inner contact is located in front of that of the corresponding outer contact under a partially overlapped manner along the front-to-back direction so that the inner contact is required to be assembled to the housing before the corresponding outer contact.

4. The electrical connector as claimed in claim 3, further comprising a center grounding contact disposed in the housing around a top face and defining a contacting section extending into the receiving channel and a mounting section exposed on said underside, wherein the mounting sections of said two pairs of contacts and said grounding contacts form a W-shaped configuration.

5. The electrical connector as claimed in claim 1, wherein the inner terminal passageway communicates downwardly with the exterior via an underside of the housing for allowing the corresponding mounting section to pass therethrough during assembling, while successively partially covered by the mounting section of the corresponding outer contact after said corresponding outer contact is assemble into the housing.

6. The electrical connector as claimed in claim 1, wherein the inner contact defines a U-shaped hook at a rear end to retain to the housing.

7. An electrical connector for use with a plug, comprising:

an insulative housing defining a central receiving channel extending along a front-to-back direction with an insertion opening in a front side of the housing;

two pairs of terminal passageways formed in the housing, each of said terminal passageways communicating transversely with the receiving channel and rearwardly with an exterior, each pair of terminal passageways including an outer terminal passageway and an inner terminal passageway;

two pairs of contacts disposed in the corresponding two pairs of terminal passageways, respectively, and categorized with outer and inner contacts corresponding to the outer and inner terminal passageways, each of said contacts being configured to be adapted to be assembled into the corresponding terminal passageway forwardly from a rear side of the housing, each of said contacts defining a contacting section transversely extending into the receiving channel for engagement with the plug, and a mounting section exposed outside of the housing for mounting to a printed circuit board; wherein the inner terminal passageway communicates downwardly with the exterior via an underside of the housing for allowing the corresponding mounting section to pass therethrough during assembling, while successively partially covered by the mounting section of the corresponding outer contact after said corresponding outer contact is assemble into the housing.

8. The electrical connector as claimed in claim 7, wherein said underside defines a mounting section receiving recess, and said recess defines four-step structure thereof for complying with the mounting sections of both the inner and outer contacts.

9. The electrical connector as claimed in claim 8, further including a central grounding contact with a mounting section received in a central rear edge region of said recess.

10. The electrical connector as claimed in claim 7, wherein the mounting sections of the contacts extend horizontally on an underside of the housing, and the mounting sections of the inner contacts are located in front of the mounting sections of the outer contacts.

11. The electrical connector as claimed in claim 7, wherein the mounting sections of the outer contacts are arranged transversely in one row while the mounting sections of the inner contacts are arranged transversely in another row.

12. The electrical connector as claimed in claim 11, further including a center contact located between said two pairs of contacts with a corresponding mounting section in the same row with the mounting sections of the outer contacts.

13. The electrical connector as claimed in claim 12, wherein said center contact has a corresponding contacting section extending into the receiving channel downwardly while the contacting sections of said two pair of contacts extend into the receiving channel transversely.

14. An electrical connector for use with a plug, comprising:

an insulative housing defining a central receiving channel extending along a front-to-back direction with an insertion opening in a front side of the housing;

two pairs of terminal passageways formed in the housing, each of said terminal passageways communicating transversely with the receiving channel and rearwardly with an exterior, each pair of terminal passageways including an outer terminal passageway and an inner terminal passageway;

two pairs of contacts disposed in the corresponding two pairs of terminal passageways, respectively, and categorized with outer and inner contacts corresponding to the outer and inner terminal passageways, each of said contacts being configured to be adapted to be assembled into the corresponding terminal passageway forwardly from a rear side of the housing, each of said contacts defining a contacting section transversely extending into the receiving channel for engagement with the plug, and a mounting section exposed outside of the housing for mounting to a printed circuit board; wherein each of the inner contacts includes an upper beam and a lower beam with a space therebetween through which the contacting section of the corresponding outer contact extends inwardly, a hook portion is formed on the upper beam to secure the inner contact in position, and the contacting sections of both of said inner contacts and said outer contacts are outwardly deflectable in response to insertion of the plug into the receiving channel.

15. The electrical connector as claimed in claim 14, wherein the mounting sections of the contacts extend horizontally on an underside of the housing, and the mounting sections of the inner contacts are located in front of the mounting sections of the outer contacts.

16. The electrical connector as claimed in claim 14, wherein the mounting sections of the outer contacts are arranged transversely in one row while the mounting sections of the inner contacts are arranged transversely in another row.

17. The electrical connector as claimed in claim 16, further including a center contact located between said two pairs of contacts with a corresponding mounting section in the same row with the mounting sections of the outer contacts.

18. The electrical connector as claimed in claim 17, wherein said center contact has a corresponding contacting section extending into the receiving channel downwardly while the contacting sections of said two pair of contacts extend into the receiving channel transversely.

19. The electrical connector as claimed in claim 14, wherein in each inner contact, the contacting section is at a position where the corresponding upper beam and lower beam are joined together.

20. The electrical connector as claimed in claim 19, wherein in each inner contact, the hook portion is formed at a rear end of the upper beam, and the mounting section is formed on the lower beam.

* * * * *